US006039594A

United States Patent [19]

Zuppa

[11] Patent Number: 6,039,594

[45] Date of Patent: Mar. 21, 2000

[54] BODY FOR ELECTRICAL OUTLET OR PLUG

[75] Inventor: Riccardo Zuppa, Brescia, Italy

[73] Assignee: Palazzoli S.p.A., Brescia, Italy

[21] Appl. No.: 09/179,132

[22] Filed: Oct. 26, 1998

[30] Foreign Application Priority Data

Dec. 3, 1997 [IT] Italy ..... BS97U0117

[51] Int. Cl.[7] ..... H01R 4/54; H01R 13/62

[52] U.S. Cl. ..... 439/318; 439/695

[58] Field of Search ..... 439/695, 599, 439/634, 684, 686, 701, 707, 712, 724, 731, 318, 314, 315, 317, 319, 333

[56] References Cited

U.S. PATENT DOCUMENTS

| | | | |
|---|---|---|---|
| 4,165,910 | 8/1979 | Anderson | 339/89 M |
| 4,464,001 | 8/1984 | Collins | 339/90 R |
| 4,542,952 | 9/1985 | Tomsa | 339/90 R |
| 4,629,272 | 12/1986 | Mattingly et al. | 339/90 R |
| 4,736,999 | 4/1988 | Marks et al. | 439/680 |
| 5,647,776 | 7/1997 | Duclos et al. | 439/752 |

*Primary Examiner*—Steven L. Stephan
*Assistant Examiner*—Chandrika Prasad
*Attorney, Agent, or Firm*—McGlew and Tuttle, P.C.

[57] ABSTRACT

An electrical outlet or plug for industrial and/or tertiary use, which comprises a body (10) consisting of two complementary elements and is provided with a spring-like stopping device in the form of a spring-like tongue (16), which forms a single piece with one of the elements of the body and engages, by springing, with a support shoulder (19) on the other element of the body.

10 Claims, 2 Drawing Sheets

BODY FOR ELECTRICAL OUTLET OR PLUG

FIELD OF THE INVENTION

The present utility model pertains, in general, to the electrical outlets or plugs for industrial and/or tertiary use, and it pertains specifically to the body of said outlets or plugs.

BACKGROUND OF THE INVENTION

The electrical outlets or plugs for industrial or tertiary use usually comprise a body and a connecting jack, the latter being enclosed in the body and having pins for connection with the openings of a complementary outlet or having openings for connection with the pins of a plug. In general, the body consists of a grip element and a jack-holding element and the said two elements are fixed to one another in the axial direction usually with a bayonet-type connection.

According to a current embodiment, such a connection is made and secured with the insertion of a flat spring between the parts of the two elements to be connected, which spring is intended to prevent an unintentional or accidental release of the two elements once they have been joined. However, the presence of an inserted spring involves problems and complications in the assembly phase of the unit.

SUMMARY AND OBJECTS OF THE INVENTION

The primary object of the present invention is to prevent such problems by the elimination of the inserted spring, but still securing a positive connection and fixation between the two elements that form the body of an electrical outlet or plug.

This object is accomplished, according to the present invention, with at least one peripheral spring-like tongue, which is made in one piece, by means of molding, with one of the elements of the outlet or plug body, and is intended for interfering and engaging, by springing, with the other element when the said body is assembled so as to prevent the unintentional disassembly thereof.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
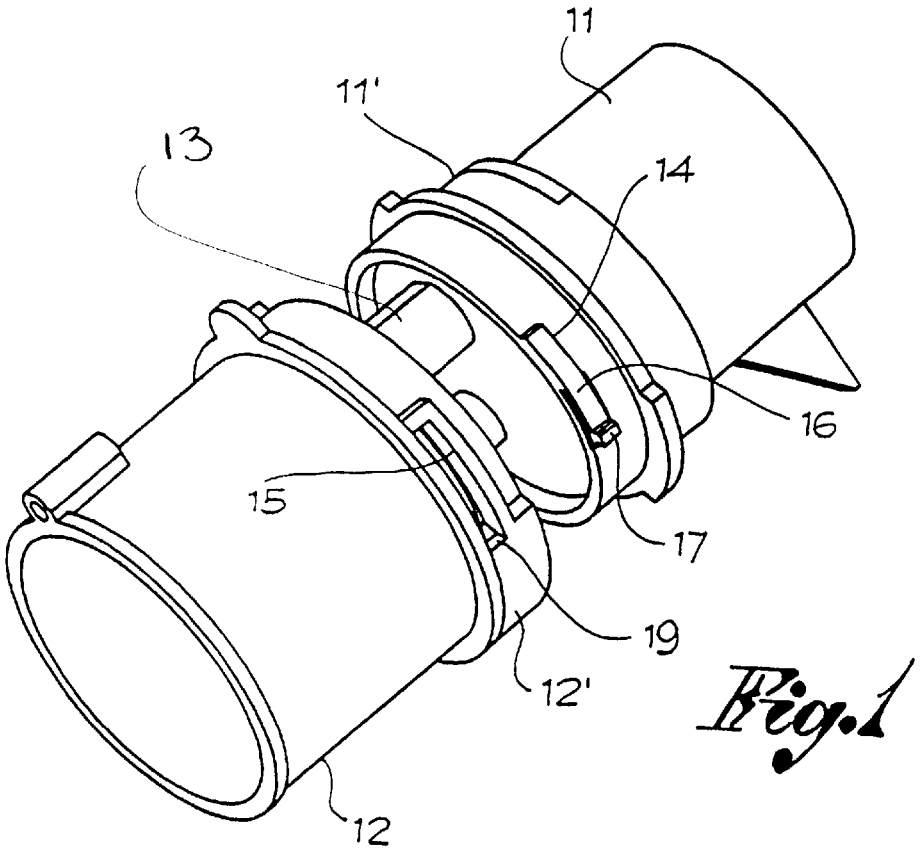
FIG. 1 is a schematic perspective view showing the two elements of the body of an electrical plug, disassembled.
Figure 2:
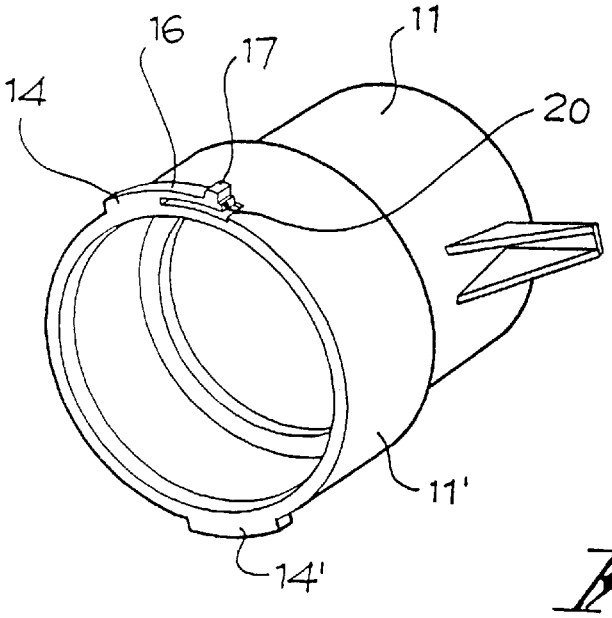
FIG. 2 is a front view of the element with spring-like tongue.
Figure 3:
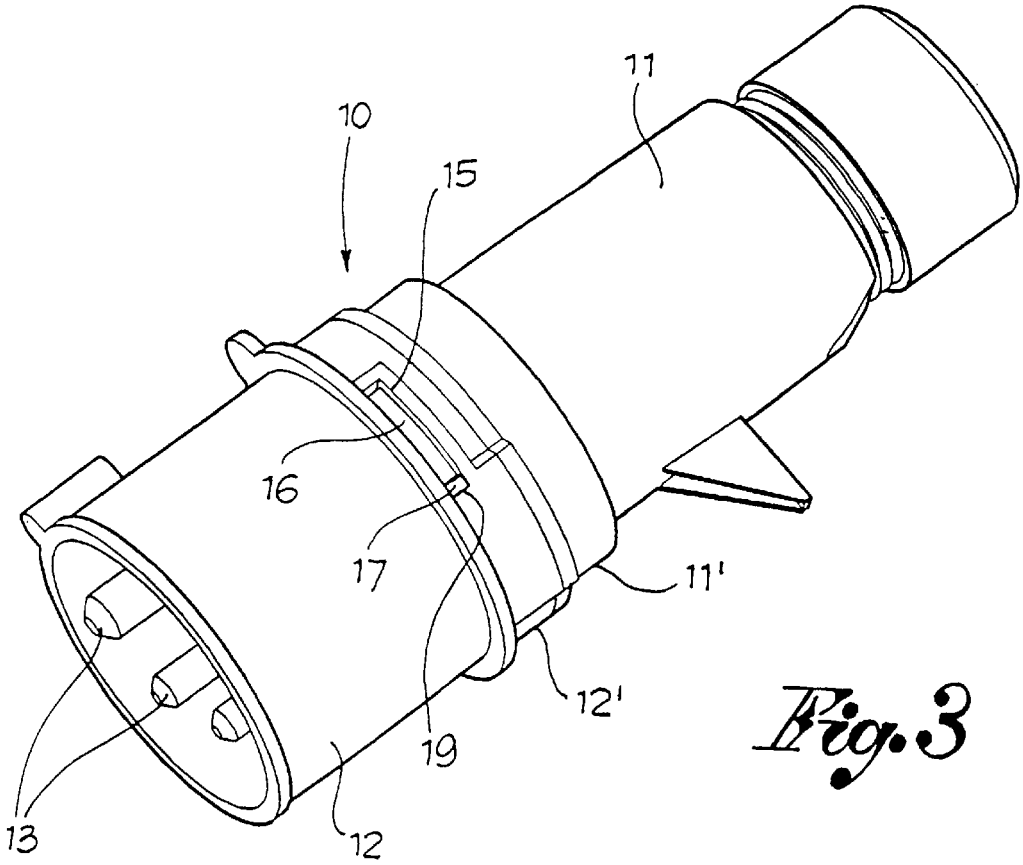
FIG. 3 is a perspective view of an assembled plug body.

Referring to the drawings in particular, the body of an electrical plug is indicated globally as 10. This body 10 includes a grip element 11 and a holder element 12, which holds a connecting jack, which, in the case shown is provided with pins 13 (FIG. 1). The grip element 11 has a collar 11' which is inserted into a collar 12' of the jack-holding element 12, and the two elements 11, 12 are joined by means of a bayonet connection.

For this purpose the collar 11' of the grip element 11 has two radial fins 14, 14' and the collar 12' of the jack-holding element 12 has two seats or slits 15, 15' which are intended for accommodating the fins 14, 14' following an axial and rotating movement of one element in relation to the other.

The grip element 11 also has at least one spring-like stopping tongue 16, which is intended to maintain the fixation between the two elements 11, 12, once they have been connected.

According to the present invention, this tongue 16 is made in a single piece, i.e., by molding, with the element 11. More precisely, the spring-like tongue 16 is a continuation of an end of a radial fin 14 of the element 11, extends in the direction opposite the direction of rotation which makes possible the bayonet connection between the two elements of the body, and it ends with a tooth 17 turned outwards. On the other hand, a cam surface 18 that is suitable for bringing about a bending (inwards) of the spring-like tongue 16 during the the connection of the two elements 11, 12 of the body 10 may be provided on the bottom of one of the seats or slits 15 that are intended to accommodate the fins 14.

Figure 4:
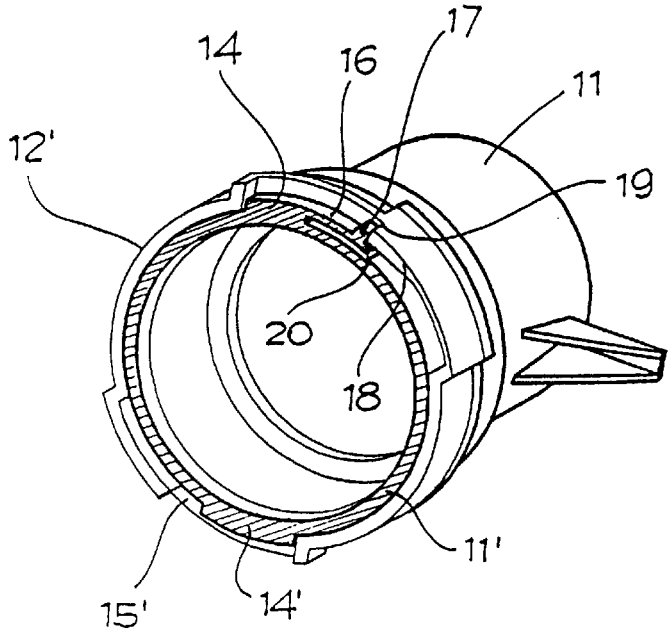
FIG. 4 is a cross sectional view of the assembled plug body.

In practice, during the corresponding rotation of the two elements 11, 12 for their connection the spring-like tongue 16 bends first, being spring-loaded, thanks to the contact of its end tooth 17 with the bottom and/or the cam surface 18 of the seat or slit 15, in which it is inserted. Then, when the fins 14 are against the limit stop strokes, the spring-like tongue 16, reacting, returns to the original position, in which its end tooth 17 is engaging against a shoulder 19 at the end of the seat or slit opposite that against which the fin, which is made in one piece with the tongue, rests (FIG. 4). The tooth 17 of the tongue will then prevent the reverse rotation of one element of the body in relation to the other, thus inhibiting their unintentional or accidental disassembly. In fact, the two elements 11, 12 of the body 10 may be disconnected intentionally only by intervening from the outside using a tool to bend the tongue 16 inwards until its tooth 17 is released from the support shoulder 19.

At the free end of the spring-like tongue 16 may be provided an attachment 20, which extends beyond the tooth 17 to engage inside the collar of the element 12, at the edge of the seat or slit 15 when the elements are connected, and the tooth 17 engages against the shoulder 19. The function of such an attachment is to prevent the spring-like tongue from being bent and pushed outwards, deforming it, following a forced rotation of one element of the body in relation to the other.

Finally, it should be noted that the position of the fins and of the slits may be reversed with the former on the jack-holding element and the latter on the grip element.

While a specific embodiment of the invention has been shown and described in detail to illustrate the application of the principles of the invention, it will be understood that the invention may be embodied otherwise without departing from such principles.

What is claimed is:

1. An electrical outlet or plug for industrial and/or tertiary use, the electrical outlet or plug comprising:

a body enclosing a connecting jack, said body including a grip element and a jack-holding element, which are joined in an axial direction by means of a bayonet connection and by positioning at least one spring-like stopping means between said grip element and said jack-holding element, one of said grip element and said jack-holding element of said body having radial fins and the other of said grip element and said jack-holding element of said body having radial fin seats for accommodating and holding said radial fins and following a corresponding rotation of one element in relation to the other, said spring-like stopping means including a spring-like tongue which forms a single piece with one of said grip element of said body and said jack-holding element of said body and engages, by spring action, with a support shoulder on the other of said grip element of said body and said jack-holding element of said body.

2. An outlet or plug in accordance with claim 1, wherein said radial fins are on the grip element, and said radial fin seats are slits on said jack-holding element.

3. An outlet or plug in accordance with claim 1, wherein said radial fins are on said jack-holding element, and said radial fin seats are slits on said grip element.

4. An outlet or plug in accordance with claim 1, wherein said spring-like tongue is made in one piece with and as a continuation of an end of one of said radial fins intended for engaging with said radial fin seats.

5. An outlet or plug in accordance with claim 2, wherein said spring-like tongue is made in one piece with and as a continuation of an end of one of said radial fins intended for engaging with said radial fin seats.

6. An outlet or plug in accordance with claim 3, wherein said spring-like tongue is made in one piece with and as a continuation of an end of one of said radial fins intended for engaging with said radial fin seats.

7. An outlet or plug in accordance with claim 4, wherein said spring-like tongue extends from an associated fin in a direction opposite the direction of rotation, which makes possible a bayonet connection between said elements of said body, and ends with a tooth turned outwards to engage with said support shoulder when said two elements are joined to one another in order to inhibit the opposite rotation, which makes possible the release of said two elements.

8. An outlet or plug in accordance with claim 7, wherein said radial fins are on said grip element of said body, said radial fin seats are on said jack-holding element, and said spring-like tongue is made in one piece with one of said radial fins, and a said end tooth engages with a support shoulder, which is provided at one end of said radial fin seat intended for accommodating said fin with said spring-like tongue.

9. An outlet or plug in accordance with claim 8, wherein a cam surface is provided in said radial fin seat for bending said spring-like tongue inwards during rotation for connecting said two elements of said body, with said spring-like tongue springing outwards into a position of engaging with said support shoulder at an end of the rotation.

10. An outlet or plug in accordance with claim 7, wherein an attachment which engages with an edge of said radial fin seat, which defines the support shoulder for said tooth to prevent the bending and the forced bending outwards of said spring-like tongue, is provided at a free end of the said spring-like tongue.

* * * * *